US007965969B2

(12) United States Patent
Roof et al.

(10) Patent No.: US 7,965,969 B2
(45) Date of Patent: Jun. 21, 2011

(54) ACTIVE ROTATION OF AIR KNIFE FOR INCREASED PERFORMANCE

(75) Inventors: Bryan J. Roof, Newark, NY (US); Elias Panides, Whitestone, NY (US); Nicholas Kladias, Fresh Meadows, NY (US); Jorge A. Alvarez, Webster, NY (US); David D. Lalley, Rochester, NY (US); Christine A. Keenan, Fairport, NY (US); Gregory D. Gerbasi, Webster, NY (US); Gerald A. Domoto, Briarcliff Manor, NY (US)

(73) Assignee: Xerox Corporation, Norwalk, CT (US)

( * ) Notice: Subject to any disclaimer, the term of this patent is extended or adjusted under 35 U.S.C. 154(b) by 497 days.

(21) Appl. No.: 12/135,235

(22) Filed: Jun. 9, 2008

(65) Prior Publication Data

US 2009/0304419 A1 Dec. 10, 2009

(51) Int. Cl.
*G03G 15/20* (2006.01)
*G03G 15/00* (2006.01)

(52) U.S. Cl. ..... 399/323; 399/45

(58) Field of Classification Search ..... 399/323, 399/322, 398, 45

See application file for complete search history.

(56) References Cited

U.S. PATENT DOCUMENTS

| | | | | |
|---|---|---|---|---|
| 5,349,199 | A | 9/1994 | Rabjohns et al. | |
| 5,383,014 | A | 1/1995 | Nowak et al. | |
| 6,782,228 | B1 | 8/2004 | Rasch et al. | |
| 2003/0039491 | A1 * | 2/2003 | Bogoshian | 399/323 |
| 2003/0049042 | A1 * | 3/2003 | Bogoshian | 399/92 |
| 2005/0151974 | A1 | 7/2005 | Butterfield et al. | |
| 2007/0206981 | A1 | 9/2007 | Amico et al. | |
| 2008/0013991 | A1 | 1/2008 | Amico et al. | |
| 2008/0018913 | A1 | 1/2008 | Ossman et al. | |
| 2008/0063441 | A1 | 3/2008 | Burton et al. | |

FOREIGN PATENT DOCUMENTS

| | | |
|---|---|---|
| EP | 1288736 A2 | 3/2003 |
| EP | 1291736 A2 | 3/2003 |
| EP | 1959315 A1 | 8/2008 |

* cited by examiner

*Primary Examiner* — David M Gray
*Assistant Examiner* — Rodney Bonnette
(74) *Attorney, Agent, or Firm* — Ellis B. Ramirez; Prass LLP

(57) ABSTRACT

According to aspects of the embodiments, there is provided a method of optimizing an electro-photographic reproduction machine having a fusing subsystem and an air knife. The methods acquire at least one electro-photographic reproduction machine objective and media characteristic; and the acquired objective and characteristic are used to determine values for the pressurized air emitted from the air knife, the position of the air knife, and the rotation of the air knife relative to a fuse roll in the fusing subsystem. The methods further disclose acquiring the leading edge of the media being stripped and then using the beam strength of the media to assist in stripping the body of the sheet. The air knife can be controlled by a controller or a processor based on determined optimization parameter values that relate to objectives and media characteristics.

18 Claims, 9 Drawing Sheets

ACTIVE ROTATION OF AIR KNIFE FOR INCREASED PERFORMANCE

BACKGROUND

The present disclosure pertains to fusers and methods for stripping printed paper or media or media sheets from a fusing member.

Typically, in an electro-photographic reproduction machine, toner is permanently fixed to the substrate via means of a fusing subsystem. This subsystem can have many different architecture types. Pressure fixing involves applying pressure and heat for sufficient time to melt and flow the toner into the substrate. The pressure can be formed by roll pairs, belts, and many combinations thereof. Traditionally silicone or Viton with a layer of silicone oil on the surface as a release layer are materials of choice for high speed pressure fusing on cut sheet equipment.

In recent years, there has been more and more usage of silicone members with a Teflon overcoat as the release surface. Once the paper has the material effectively fused, the paper must be removed from the fuse member. This is typically done either by direct mechanical means, such as stripping fingers, or by indirect methods such as creep (strain based) stripping or air stripping. In recent studies it was determined that when stripping with an air knife, the optimal conditions for stripping uncoated paper were different than those for coated paper. Furthermore, it was found that optimal conditions for acquiring a lead edge were different than the optimal conditions for effectively stripping the body of a sheet. When referring to optimal conditions, the primary parameters of interest are referred to as phi which defines an angle made between an orifice at the air knife and a tangent to the roll at an impingement point; theta defining an angle from the nip exit to the impingement point about the fuse member radius; d defining distance from the orifice exit to the impingement point along an orifice axis; and air pressure in the plenum prior to exiting the orifice at the air knife.

SUMMARY

According to aspects of the embodiments, there is provided a method of optimizing an electro-photographic reproduction machine having a fusing subsystem and an air knife. The methods acquire at least one electro-photographic reproduction machine objective and media characteristic; and the acquired objective and characteristic are used to determine values for the pressurized air emitted from the air knife, the position of the air knife, and the rotation of the air knife relative to a fuse roll in the fusing subsystem. The methods further disclose acquiring the leading edge of the media being stripped and then using the beam strength of the media to assist in stripping the body of the sheet. The air knife can be controlled by a controller or a processor based on determined optimization parameter values that relate to objectives and media characteristics.

DETAILED DESCRIPTION

Aspects of the disclosed embodiments relate to methods for optimizing an electro-photographic reproduction machine, and corresponding apparatus and systems. The disclosed embodiment proposes the optimization of parameters of an air knife between jobs and within sheets. Specifically, theta and phi are parameters that would be desired to change for coated vs. uncoated media and for body stripping vs. lead edge acquisition. Due to geometry concerns, the distance (d) of the air knife from a fuse roll may also be adjusted as theta and phi are adjusted. Due to down stream handoffs and to other geometry considerations, theta, phi, and "d" would also need to be adjusted to not only optimize for the different conditions, but also maintain integrity of paper path handoffs.

The disclosed embodiments include methods for optimizing an electro-photographic reproduction machine that has a fusing subsystem comprising a fuse roll and a pressure roll to form a nip through which media passes and an air knife having an orifice directing a stream of pressurized air at an impingement point on the fuse roll. After acquiring the electro-photographic machine objectives, e.g. body stripping vs. lead edge acquisition, and media characteristics, e.g. coated vs. uncoated paper, a set of optimization parameters determined. The determined optimization parameters can include rotation of theta, phi, and adjustment of "d" as needed for optimal performance of a particular media being stripped for a given pressure.

The disclosed embodiments further include an apparatus or system for acquiring the electro-photographic machine objectives and media characteristics to determine a set of optimization parameters. The determined optimization parameters can be employed by a controller or processor to rotate, position, and regulate the stream of pressurized air being emitted by the air knife.

The term "electro-photographic printing machine," "reproduction apparatus," or "printer" as used herein broadly encompasses various printers, copiers or multifunction machines or systems, xerographic or otherwise, unless otherwise defined in a claim. The term "media" herein refers to a physical sheet of paper, plastic, or other suitable physical substrate for images, whether precut or web fed. Also media refers to different types of print media with different media characteristics, such as thickness, roughness, moisture content, etc. A "copy sheet" may be abbreviated as a "copy" or called a "hardcopy."

Figure 1:
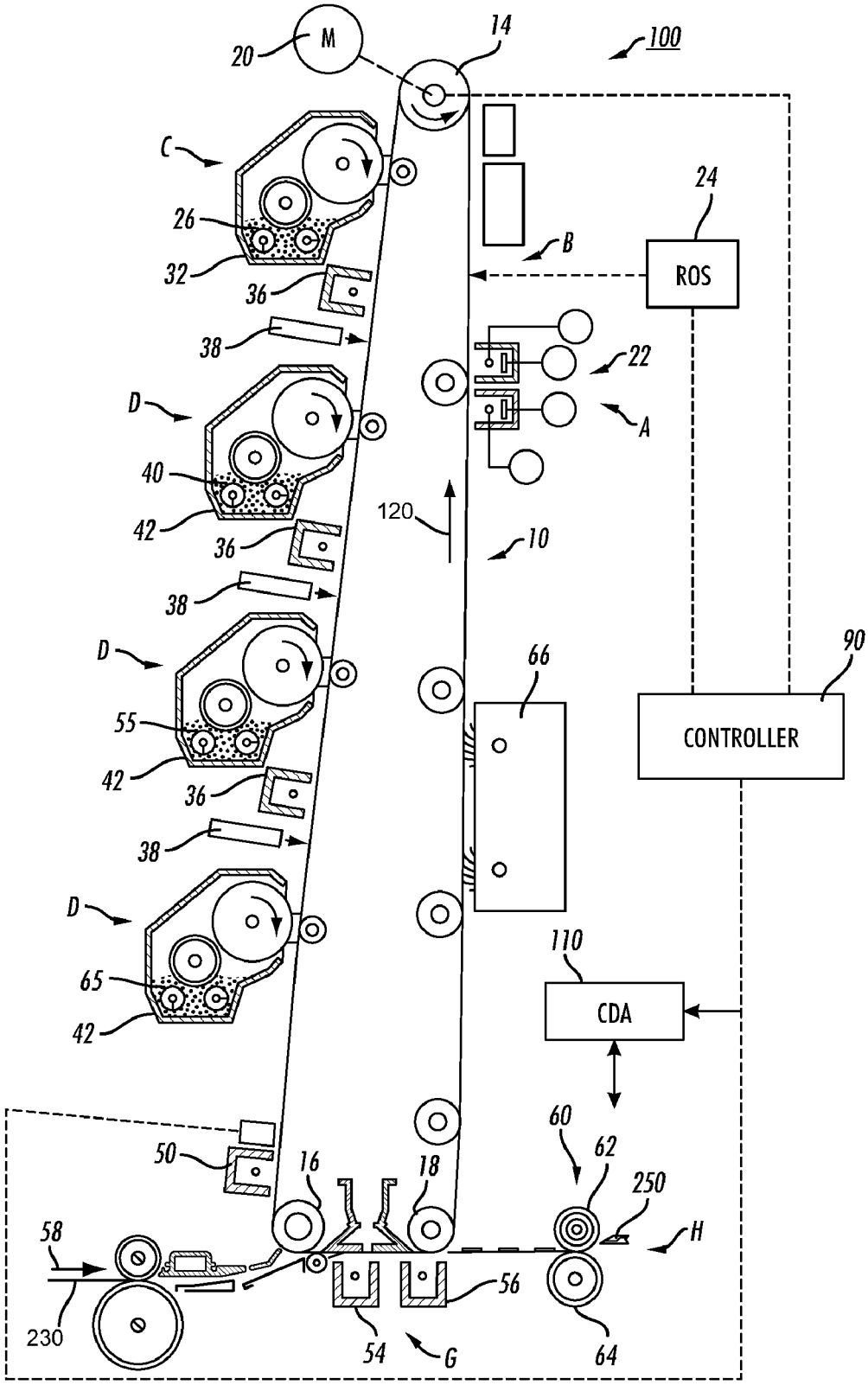
FIG. 1 is a schematic elevational view of an electro-photographic printing machine utilizing the device described herein.

FIG. 1 illustrates a diagram of an electro-photographic printing machine 100. The electro-photographic printing machine uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and tension and steering rollers 16 and 18 respectively, roller 14 is operatively connected to a drive motor 20 for effecting movement of the belt through the xerographic stations. A portion of belt 10 passes through charging station A where a corona generating device, indicated generally by the reference numeral 22, charges the photoconductive surface of belt 10 to a relative high, substantially uniform, preferably negative potential. The charged portion of photoconductive surface is advanced through an imaging station B. At exposure station B, the uniformly charged belt 10 is exposed to a laser based output-scanning device 24 that causes the charge retentive surface to be discharged in accordance with the output from the scanning device. The scanning device can be a laser Raster Output Scanner (ROS). Alternatively, the ROS could be replaced by other xerographic exposure devices such as LED arrays. At first development station C, developer structure, indicated generally by the reference numeral 32 utilizing a hybrid jumping development (HJD) system, the development roll, better known as the donor roll, is powered by two development fields potentials across an air gap). The toner cloud causes charged toner particles 26 to be attracted to the electrostatic latent image. Appropriate developer biasing is accomplished via a power supply. This type of system is a non-contact type in which only toner particles (magenta, for example) are attracted to the latent image and there is no mechanical contact between the photoreceptor and a toner delivery device to disturb a previously developed, but unfixed, image.

A second exposure/imaging is performed by imaging device 38 that comprises a laser based output structure and is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HJD system. A power supply (not shown) serves to electrically bias the developer structure to a level effective to develop the discharged image areas with negatively charged yellow toner particles 40.

Subsequent to image development a sheet of support material 52 is moved into contact with the toner images at transfer station G. The sheet of support material is advanced to transfer station G by a sheet feeding apparatus to the pretransfer device which directs the advancing sheet of support material into contact with photoconductive surface of belt 10 in a timed sequence so that the toner powder image developed thereon contacts the advancing sheet of support material at transfer station G. Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

Figure 10:
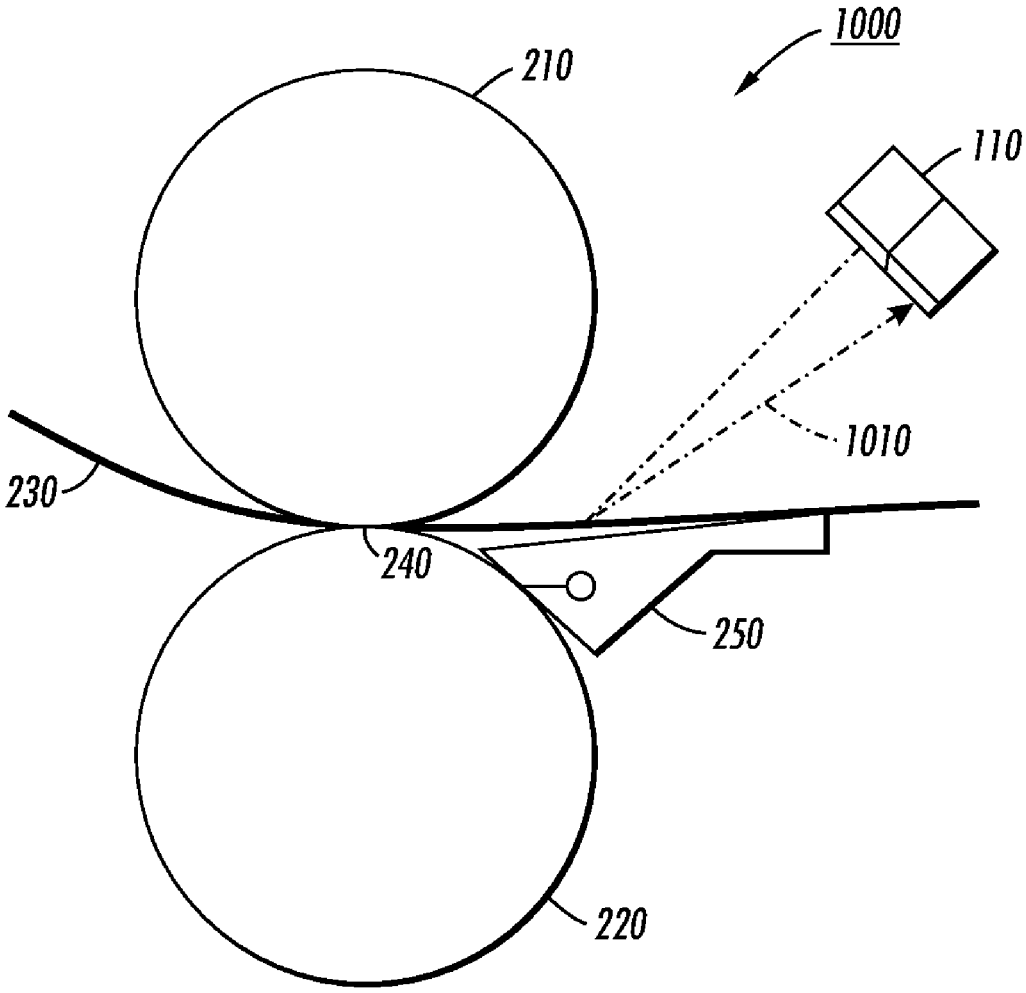
FIG. 10 is an enlarged end section schematic of the fusing assembly or media removal apparatus showing an air knife with leading edge acquisition in accordance with the present disclosure.

After transfer of toner material at 55 and 65 and charging from charging device 36, the sheet continues to move, in the direction of arrow 58, onto a conveyor (not shown) which advances the sheet to fusing station H or fusing subsystem. The applied toner can be conditioned by dicorotron member 50 for effective transfer. Fusing subsystem includes a fuser assembly, indicated generally by the reference numeral 60, which permanently affixes the transferred powder image to sheet 52. The fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, the sheet is separated from the fuser roll by an air knife, described in more detail below, to a chute which guides the advancing sheets 52 to a catch tray for subsequent removal from the printing machine by the operator. An air knife 250 provides a stream of air to assist in separating the fused sheet from the heated fuser roll. With lighter weight sheets with a heavy toner image near the lead edge of the sheet, the sheet sometimes might either not separate from the fuser or, due to the lack of beam strength of the sheet, might retack to the fuser roll and cause a jam. Air knife 250 can be controlled by controller data acquisition (CDA) 110 and controller 90. CDA 110 controls air knife 250 by rotation, displacement, and by regulating the stream of pressurized air being emitted from the nozzle. CDA 110 uses signals 1010 as shown in FIG. 10 to determine the position of a moving media.

After the sheet of support material is separated from photoconductive surface of belt 10, the residual toner particles carried by the non-image areas on the photoconductive surface are removed therefrom. These particles are removed at cleaning station using a cleaning brush structure contained in a housing 66.

Figure 2:
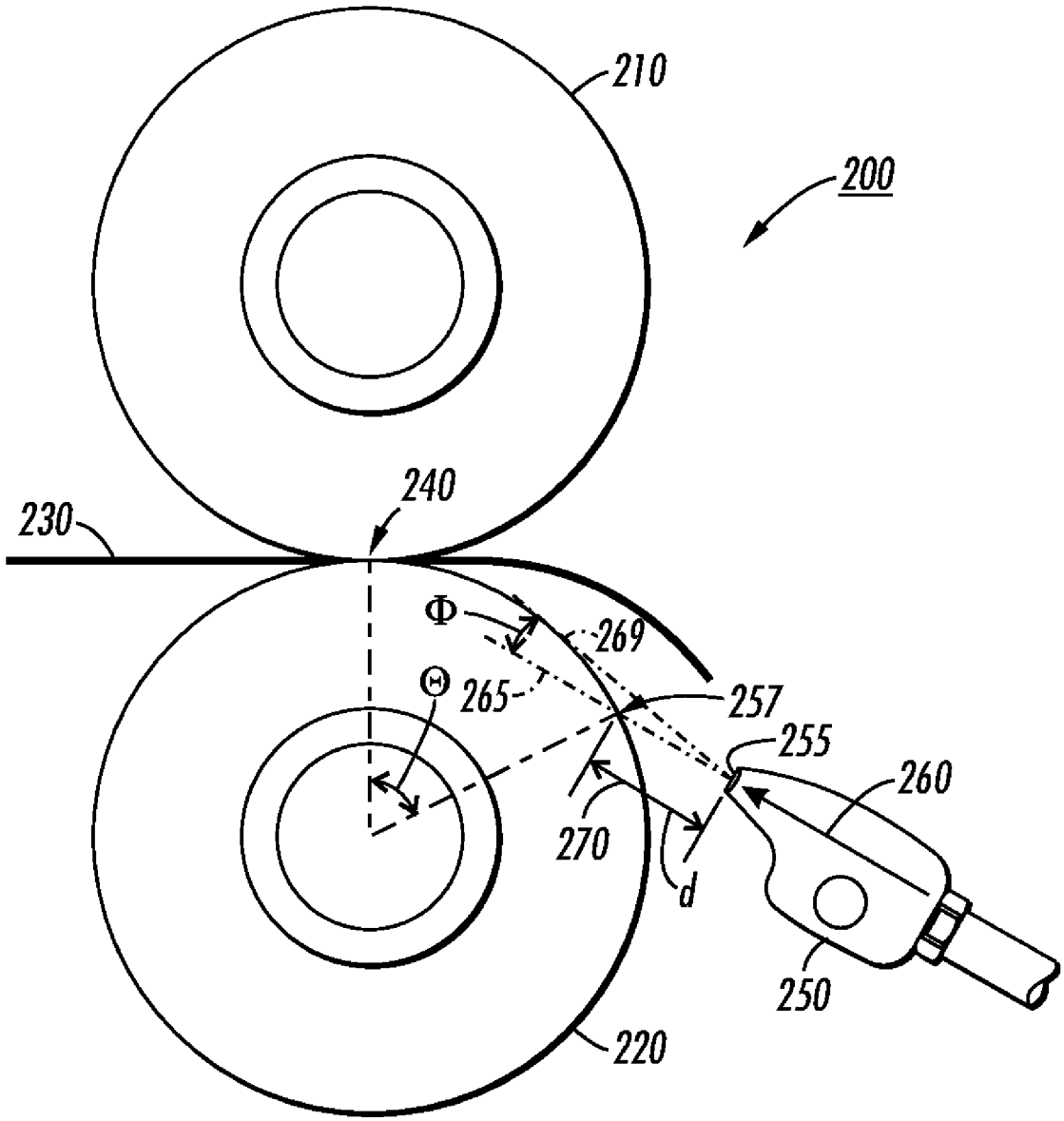
FIG. 2 is an enlarged end section schematic of the fusing assembly or media removal apparatus showing an air knife in accordance with the present disclosure.

FIG. 2 is an enlarged end section schematic of the fusing assembly 200 or media removal apparatus showing an air knife 250 in accordance with the present disclosure. In particular fusing assembly 200 includes a pressure roll 210, a fuse roll 220, and an air knife 250. Preferably, fusing subsystem 200 includes a fuser roller 220 having a surface, and a pressure roller 210 that form a fusing nip 240 through which the sheet is passed with a powder image on the copy sheet contacting fuser roller 220. The pressure roller 210 is loaded against the fuser roller 220 forming the fusing nip 240 for providing the necessary pressure to fix an image to the copy sheet. The fuser roll 220 for example could be internally heated by a quartz lamp (Not shown). The fuser roll surface 220 may be lubricated by a release agent, stored in a reservoir (not shown), for application to the surface of the fuser roll prior to the sheet contacting the surface of fuser roll 220. At the exit point of the fusing nip 240, sheet 52 separates from coated surfaces by the sheet stripping assembly or air knife 250 of the present disclosure.

The air knife 250 includes a nozzle or orifice 255 for emitting a stream 260 of pressurized air. The stream 260 of pressurized air from the orifice 255 impinges on the fuser roll 220 at impingement point 257. A line 265 coincides with the air stream 260, and passing through the impingement point 257 forms a first angle with a line 269 extending from the orifice 255 and forming a tangent to the fuse roll 220. The orifice of the air knife forms a coordinate with the impingement point that is tangent to the circumference of fuse roll 220. The impingement point and the stream of pressurized air from the air knife form a first angle, "phi" (ϕ). The nip and the impingement point form a second angle, "theta" (θ). The nozzle or orifice of the air knife 250 is positioned at a given distance, "d", from the impingement point. It should be noted that a pneumatic means (not shown) with air stream regulating means can be employed to regulate aspects such as volume, pressure, direction of the pressurized air 270. It should be noted that the air knife 250 could be rotated around its own axis and can be displaced away or towards the impingement point on the circumference of the fuse roll.

Figure 3:
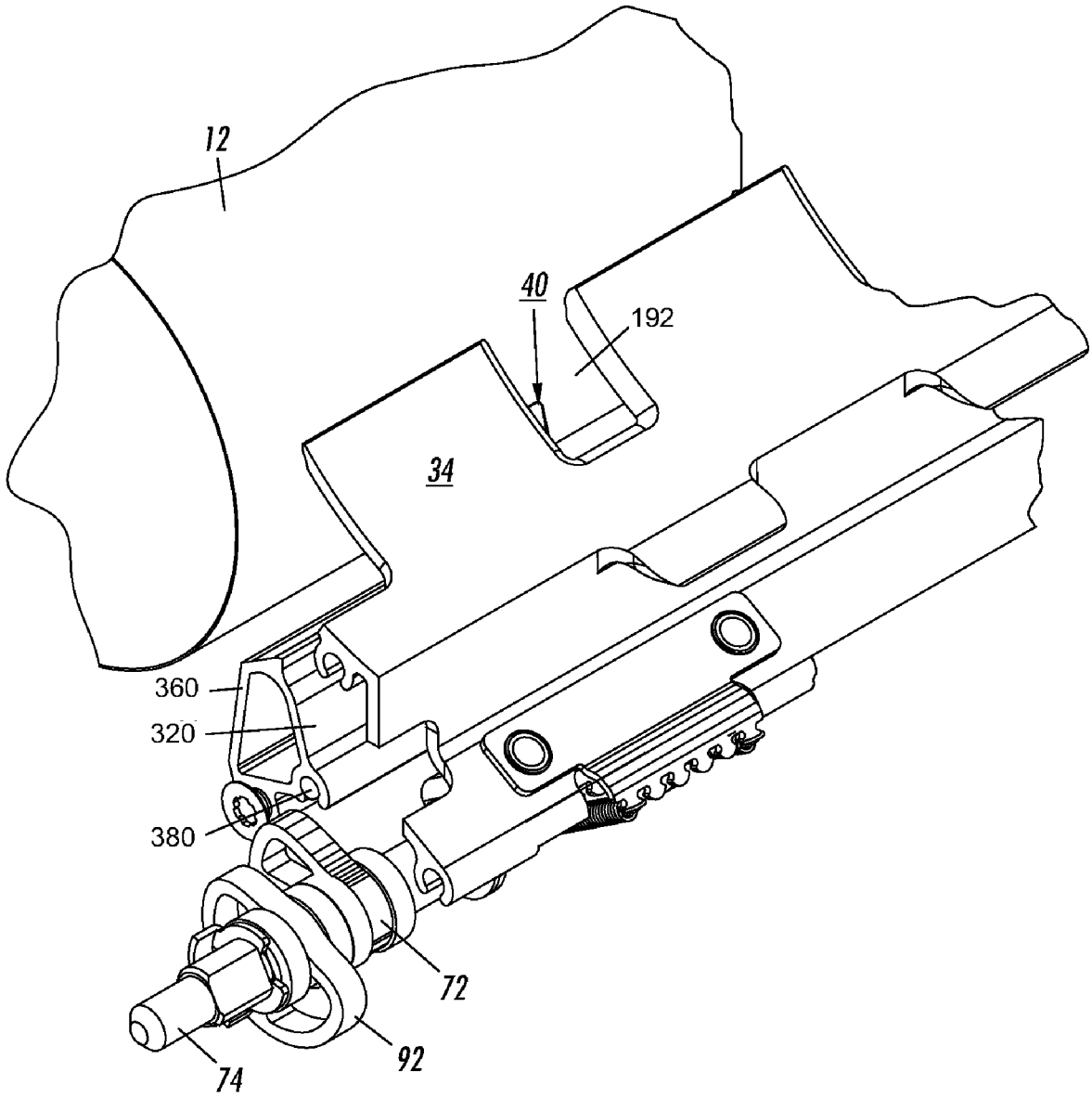
FIG. 3 is a perspective view of a media removal apparatus viewed from the fuser nip exit.
Figure 4:
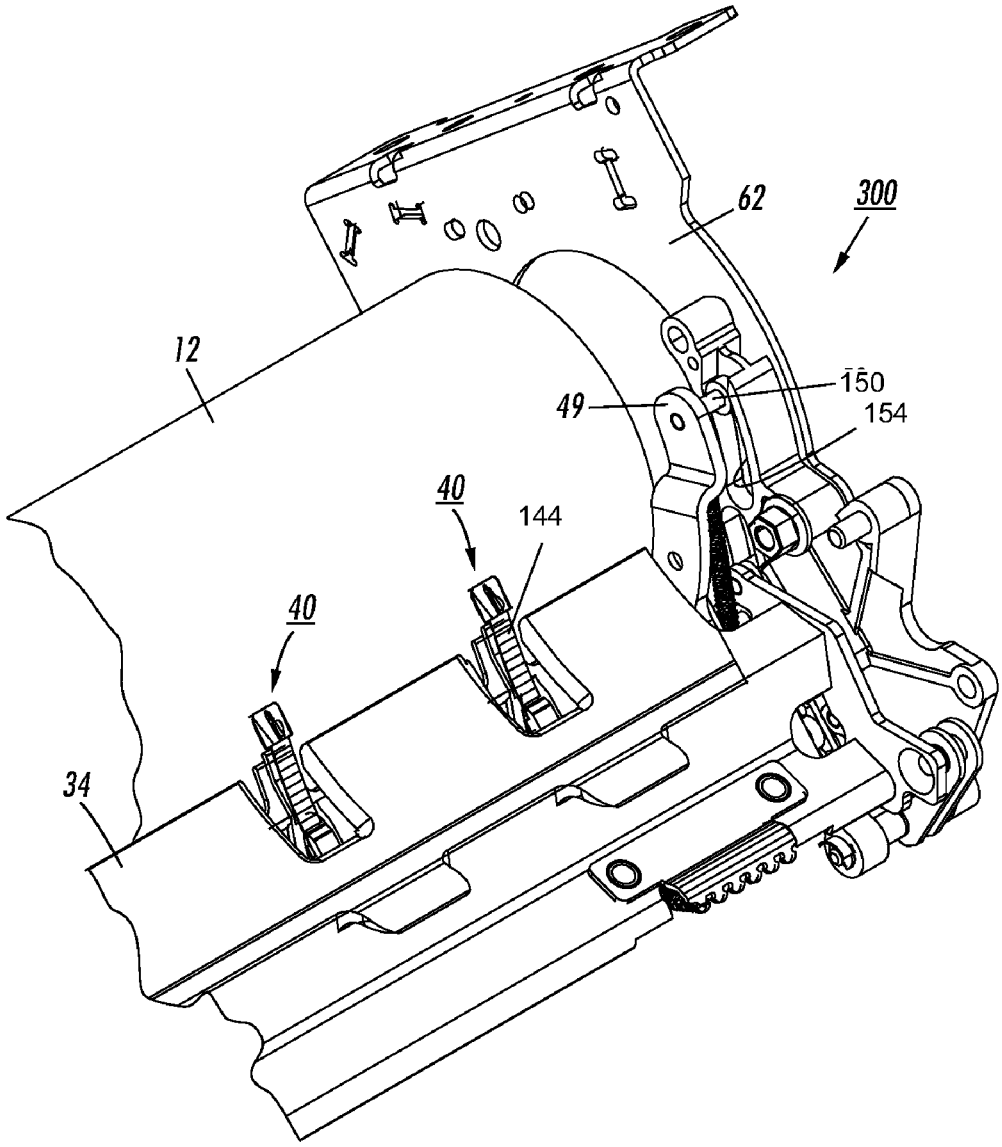
FIG. 4 is a perspective view of a media removal apparatus viewed from the nip exit side of the fuser illustrating the stripper fingers.

FIG. 3 shows perspective view of a media removal apparatus 300 viewed from the fuser nip exit and FIG. 4 shows a perspective view of a media removal apparatus 300 viewed from the nip exit side of the fuser illustrating the stripper fingers. The stripper finger structure 320 comprises a generally triangular base member 360 carrying a shaft 380 that is substantially coextensive with the length of the triangular base member. The shaft 380 pivotally supports a plurality of stripper finger assemblies 40. In particular, media removal apparatus 300 includes a fuser roll 12, stripper baffle 34, stripper finger structure 320, cam finger shaft 380, support arm 49, lower guide 150, track 154, a first cam 72, frame member 62, a camshaft 74, and a second cam 192. The leaf springs 144 serve to provide suitable biasing of the fingertips into engagement with the surface of the heated fuser roll for effecting lead-edge separation of an imaging media. An imaging media sensor is positioned adjacent the media transport for sensing the position of imaging media. Firmware in CDA 110 processes signals generated by a media position sensor (not shown) for controlling operation of a finger stripper structure 300 forming a part of a media removal apparatus. Further, sidewardly projecting pin member that is received in a first track forming a part of the track structures. The other end of the baffle arm is pivotally mounted on a shaft. The shaft also supports a boomerang shaped linkage adjacent one end thereof. The linkage is supported proximate its center by the stationary shaft. The other end of the linkage 88 acts as a cam follower that operatively engages cams carried by the camshaft. The cams 92 effect automatic movements of the stripping baffle structure between its home or standby position and an active position proximate the heated fuser roll for separating the portion of the imaging media beyond the lead edge portion separated by the strippers. The cams cause the cam follower ends of the linkage to rotate about the stationary shaft that, in turn, causes the shaft to move the arms attached to the baffle base member. The stripping baffle structure 34 comprises a castellated base member with openings through which the stripper finger assemblies pass during relative movement of the stripper finger and baffle structures. The function of the stripping baffle is to effect separation of the remainder of the imaging media after the lead edge thereof has been separated from the heated fuser roll by the stripper fingers. To this end, the stripper baffle is adapted to be moved from a home or standby position to continue separation of the imaging media once the stripper fingers have separated the lead edge of the imaging media. The shaft 38 pivotally supports a plurality of stripper finger assemblies 40. Each stripper finger assembly comprises a base member (not shown) fabricated from a suitable plastic or metal material.

Figure 5:
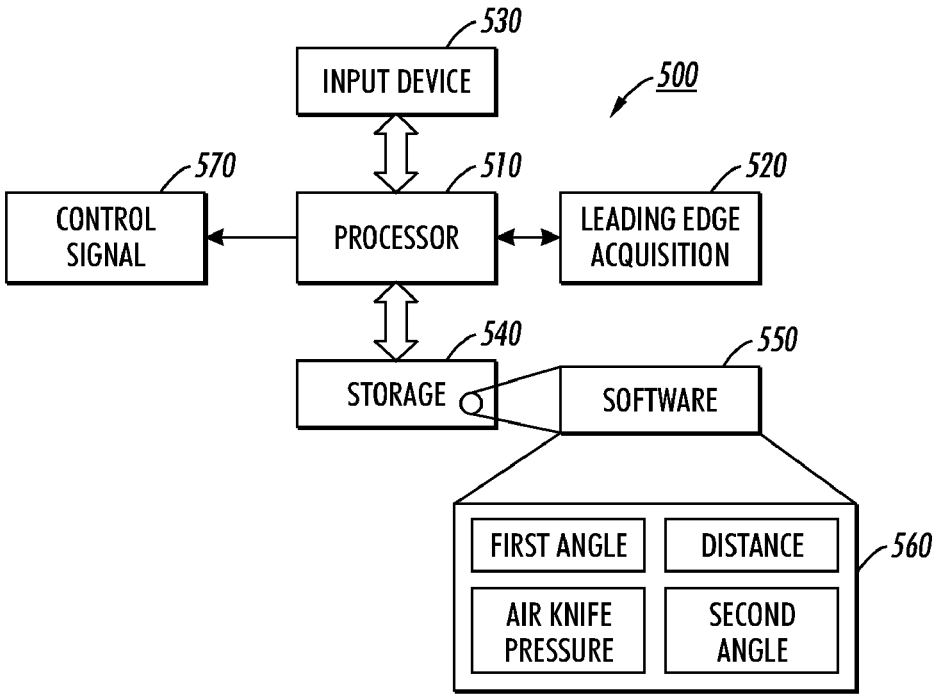
FIG. 5 is a block diagram of a system for controlling an air knife in accordance with the present disclosure.

FIG. 5 is a block diagram of a system 500 for controlling an air knife in accordance with the present disclosure. System 500 comprises an input device 530 for receiving inputs from a user such as electro-photographic reproduction machine objectives and media characteristics, or data from optical sensors that indicate information as to the media being used for a particular job. Processor 510 may include at least one conventional processor or microprocessor that interprets and executes instructions. Storage 540 may be a random access memory (RAM) or another type of dynamic storage device that stores information and instructions for execution by processor 510. Storage device 550 can include a one or more cache, ROM, PROM, EPROM, EEPROM, flash, SRAM, computer-readable medium having stored thereon a plurality of instructions, non-volatile memory (NVM), or other devices; however, the memory is not limited thereto. Storage device 540 can hold calibration data, a unique identifier for the electro-photographic reproduction machine and vision based input device, or a media access control address, and individualized software made by third parties for operating electro-photographic reproduction machine or fusing assembly. Software mean 550 may contain software objects 560 that when compiled by processor 510 determine the first angle (ϕ), the second angle (θ), the distance (d), and the pressure for the air knife. The software means 550 can also be used to perform leading edge acquisition and to generate a set of instructions to position air knife 250 at optimal position relative to the media and the fuse roll. Storage device in particular holds objects or modules for determining the optimized parameters given acquired setoff parameters from a user or from sensing devices. Once the software determines the optimized parameters, a control signal 570 is generated to position the air knife 250 at an optimal position for the job and the media being employed in the job.

Figure 6:
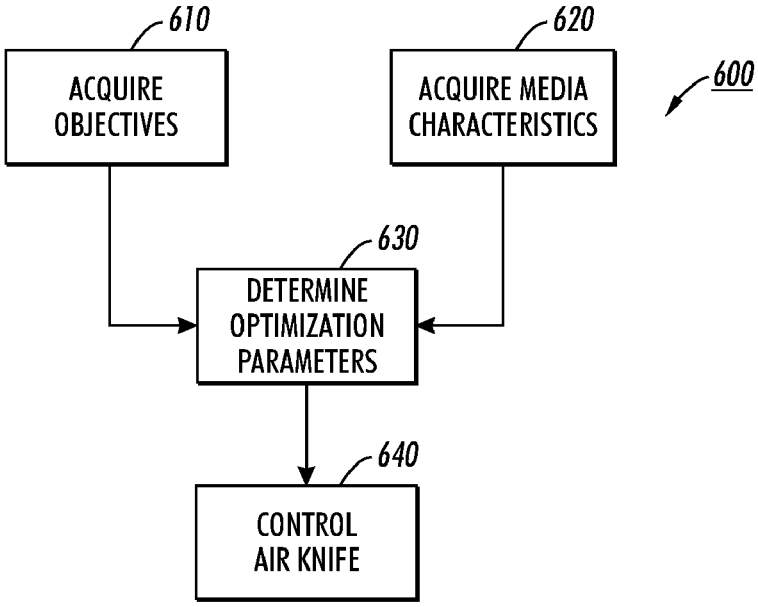
FIG. 6 illustrates a flowchart of a method for controlling an air knife based on electro-photographic reproduction machine objective and media characteristics in accordance with the present disclosure.

FIG. 6 is a flowchart of method 600 for controlling an air knife based on electro-photographic reproduction machine objective and media characteristics in accordance with the present disclosure. Method 600 begins by the acquisition of objectives 610 for the electro-photographic reproduction machine 100. As noted earlier example objectives are one of body stripping, lead edge stripping, and user defined photographic reproduction machine objective. Concurrently or sequentially, the media characteristics 620 are acquired for the particular objective being performed by the fusing subsystem. Example of media characteristics are coated media, uncoated media, physical dimension of the media, and weight of the media. Once the objectives and characteristics have been acquired control passes to action 630 for further processing.

In action 630, optimization parameters are determined for the desired situation or job being performed by electro-photographic reproduction machine 100. In action 630, a response value is calculated to determine the rotation, distance, or pressure to set air knife 250 where the response value would be maximized. Once the parameters have been determined control passes to action 640 for further processing.

In action 640, the optimized parameters are implemented to position the air knife 250 at the desired rotation, at the desired distance, and the desired pressure to operate the air knife at optimal performance. The rotation, distance, and pressure could be set manually by an operator or by the use of a controller such as CDA 110.

Figure 7:
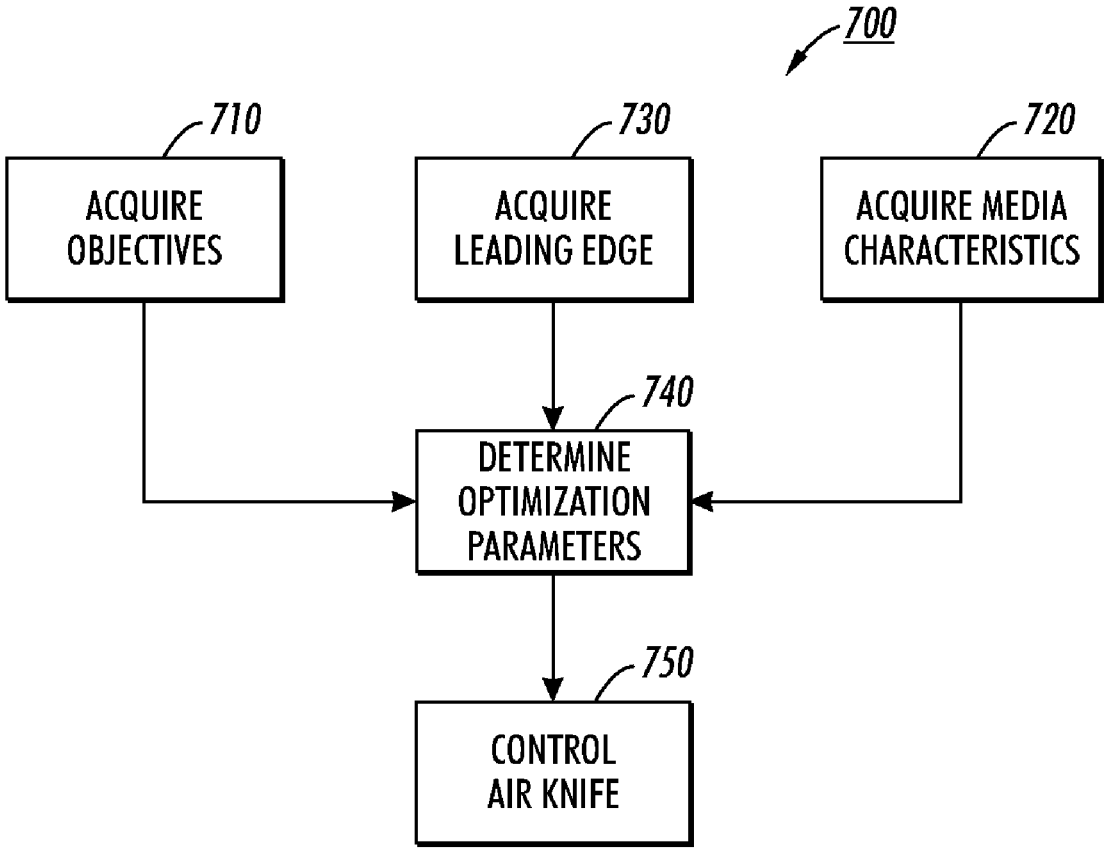
FIG. 7 illustrates a flowchart of a method for controlling an air knife based on electro-photographic reproduction machine objective, leading edge acquisition, and media characteristics in accordance with the present disclosure.

FIG. 7 illustrates a flowchart of method 700 for controlling an air knife based on electro-photographic reproduction machine objective and leading edge acquisition. Method 700 begins by the acquisition of objectives 710 for the electro-photographic reproduction machine 100. As noted earlier example objectives are one of body stripping, lead edge stripping, and user defined photographic reproduction machine objective. Concurrently or sequentially, the media characteristics 720 are acquired for the particular objective being performed by the fusing subsystem. Example of media characteristics are coated media, uncoated media, physical dimension of the media, and weight of the media. Additionally, method 700 acquires leading edge 730 data from an optical sensor such as a light emitting diode (LED) or laser, or a suitable input device. Once the objectives and characteristics have been acquired control passes to action 740 for further processing.

In action 740, the optimization parameter are determined from the acquired objectives 710, acquired leading edge 730 data, and acquired media characteristics. Once the parameters have been determined control passes to action 750 for further processing.

In action 750 the air knife 250 is controlled based on the determined optimization parameters. With the acquisition of leading edge 730 the knife pressure can be shut off or reduced so the beam strength of the paper 230 could be used to assist in stripping the body of the sheet. Using the strength of the paper for stripping reduces power losses and potential gloss defects.

When considering changes to air knife parameters in some cases it may be desirable to have only one parameter change such as theta (θ), but more likely multiple ones have to be changed simultaneously. This may necessitate multiple actuators or more complex linkages/camming mechanisms, but the design of these actuators will be specific to the architecture of the fuser subsystem 300 and is routine engineering. It should be noted that some architectures if manually actuated, i.e. for paper type will likely have discrete positions, whereas architectures that change are automatically actuated could be continuous.

Figure 8:
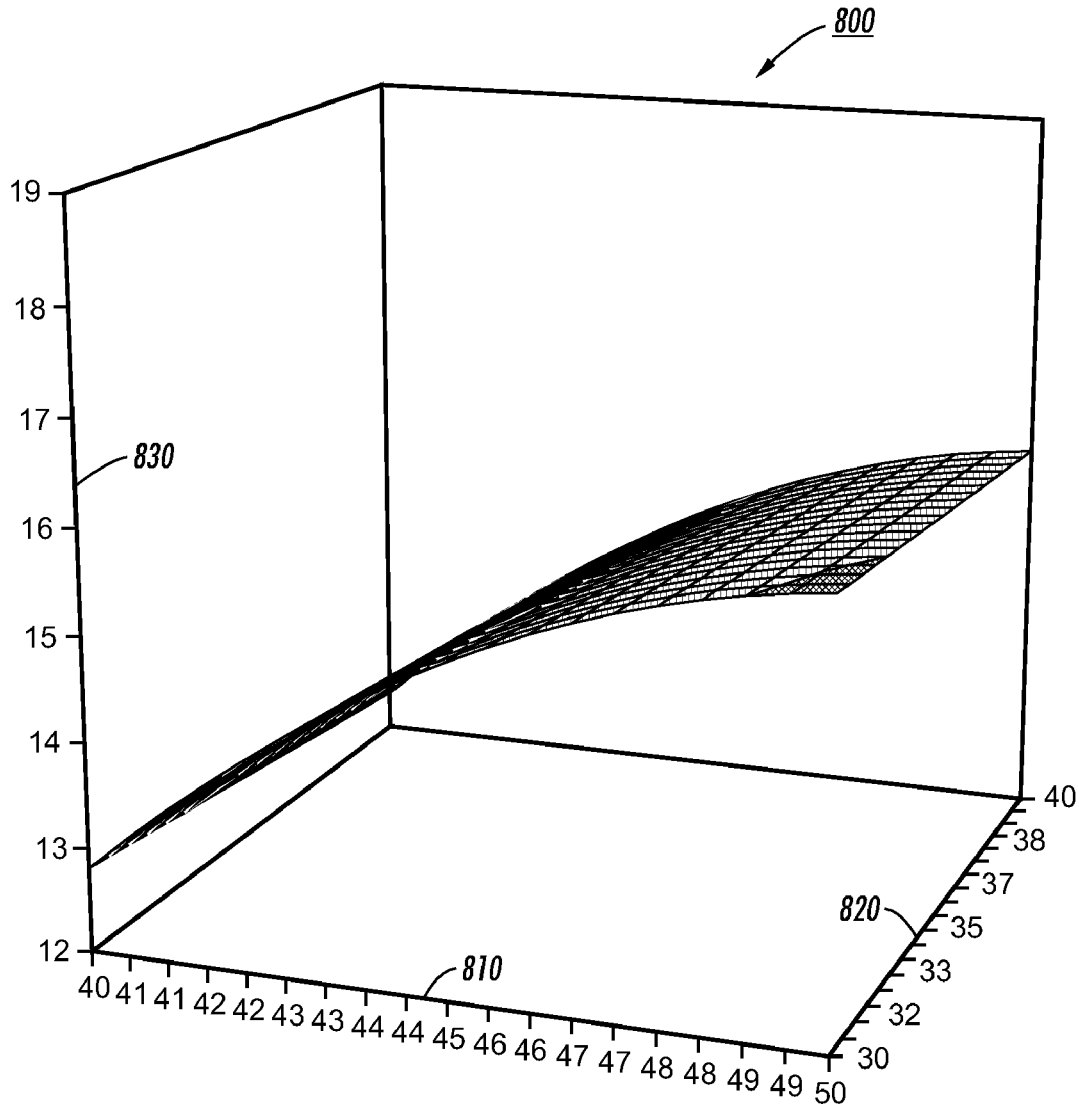
FIG. 8 is a surface plot of response value of optimal parameter conditions for uncoated media in accordance with the present disclosure.

FIG. 8 is a surface plot 800 of response value 830 of optimal parameter conditions for uncoated media in accordance with the present disclosure. The Graph shows the relationship of theta 810 (θ) and phi (ϕ) 820 for 60 gsm uncoated media for a given embodiment. The larger numbers are better for the response value shown in FIG. 8. In particular, 60 gsm uncoated performs better with a large theta and is relatively insensitive to phi. Thus, when positioning the air knife 250 for optimal performance for uncoated media one should move the air knife 250 away from the nip to increase theta (θ). Conversely, the air knife need not be rotated because phi (ϕ) is not critical to achieving optimization.

Figure 9:
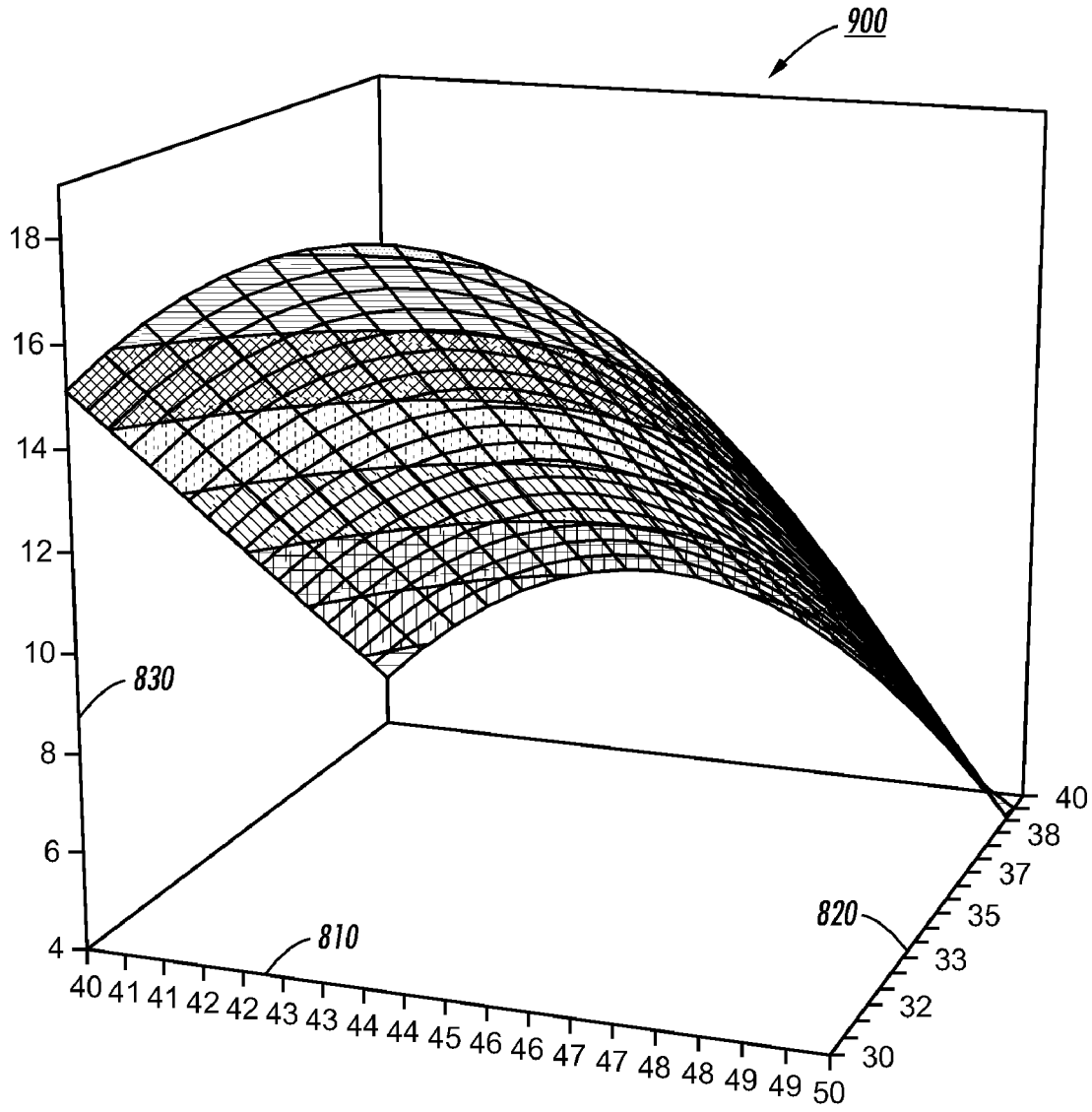
FIG. 9 is a surface plot of response value of optimal parameter conditions for coated media in accordance with the present disclosure.

FIG. 9 is a surface plot 900 of response value of optimal parameter conditions for uncoated media in accordance with the present disclosure. The Graphs shows the relationship of theta 810 (θ) and phi (ϕ) 820 for 90 gsm coated media. In particular, notice that the coated optimal conditions are different. The larger numbers are better for the response value shown in FIG. 9. In this case the point of optimization occurs at the lower phi (ϕ) 820 and lower theta (θ) 810. When optimizing air knife 250 for coated media both theta and phi should be changed to lower settings.

FIG. 10 shows an enlarged end section schematic of the fusing assembly 1000 or media removal apparatus showing an air knife 250 in accordance with the present disclosure. In particular fusing assembly 1000 includes a pressure roll 210, a fuse roll 220, and an air knife 250. Preferably, fusing subsystem 200 includes a fuser roller 220 having a surface, and a pressure roller 210 that form a fusing nip 240 through which the sheet 230 is passed with an image on the copy sheet contacting fuser roller 220. The pressure roller 230 is loaded against the fuser roller 220 forming a fusing nip for providing the necessary pressure and dwell to fix an image to the copy sheet. In addition, the fusing assembly 1000 shows controller data acquisition 110 programmed to receive leading edge acquisition from an optical sensor so as to control air knife 250. It should be noted that CDA 110 could be programmed to receive other leading edge inputs to control air knife 250.

Embodiments within the scope of the present invention may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Although the above description may contain specific details, they should not be construed as limiting the claims in any way. Other configurations of the described embodiments of the invention are part of the scope of this invention. For example, the principles of the invention may be applied to each individual user where each user may individually deploy such a system. This enables each user to utilize the benefits of the invention even if any one of the large number of possible applications do not need the functionality described herein. In other words, there may be multiple instances of the devices in FIGS. 5-10 each processing the content in various possible ways. It does not necessarily need to be one system used by all end users. Accordingly, the appended claims and their legal equivalents should only define the invention, rather than any specific examples given.

What is claimed is:

1. A method of operating a printing machine having a fusing subsystem and an air knife, comprising:

acquiring at least one electro-photographic reproduction machine objective and media characteristic;

determining optimization parameter values from the acquired at least one electro-photographic reproduction machine objective and media characteristic;

controlling the provided air knife based on the determining optimization parameter values;

wherein the fusing subsystem comprising a fuse roll and a pressure roll to form a nip through which media passes;

wherein the air knife having an orifice directing a stream of pressurized air at an impingement point on the fuse roll, wherein the air knife is rotatable and displaceable relative to the fuse roll;

wherein the impingement point and the orifice form a first angle about the circumference of the fuse roll;

wherein the nip and the impingement point form a second angle about the radius of the fuse roll;

wherein optimization parameter values comprise values for the first angle, the second angle, pressure for the stream of pressurized air, distance from the orifice to the impingement point on the fuse roll.

2. The method of claim 1, wherein photographic reproduction machine objective is one of body stripping, lead edge stripping, and user defined photographic reproduction machine objective.

3. The method of claim 1, wherein media characteristic is one of coated media, uncoated media, physical dimension of the media, and weight of the media.

4. The method of claim 2, wherein determining optimization parameters is accomplished by rotating the first angle and the second angle.

5. The method of claim 4, wherein determining optimization values comprises adjusting the distance from the orifice to the impingement point until the response value is maximized.

6. The method of claim 1, the method further comprising:

receiving leading edge data about media passing through the nip created by the fuse roll and the pressure roll.

7. The method of claim 6, wherein controlling the provided air knife is accomplished by adjusting the stream of pressurized air exiting the orifice of the air knife.

8. The method of claim 7, wherein controlling the provided air knife is accomplished by adjusting the distance from the orifice to the impingement point and rotating the air knife relative to the fuse roll.

9. A printing machine comprising:

a fusing subsystem comprising a fuse roll and a pressure roll to form a nip through which media passes;

an air knife having an orifice directing a stream of pressurized air at an impingement point on the fuse roll, wherein the air knife is rotatable and displaceable relative to the fuse roll;

processor to determine optimization parameter values from an acquired at least one electro-photographic reproduction machine objective and media characteristic;

a controller to control the air knife based on the determined optimization parameter values; and wherein the impingement point and the orifice form a first angle about the circumference of the fuse roll;

wherein the nip and the impingement point form a second angle about the radius of the fuse roll;

wherein optimization parameter values comprise values for the first angle, the second angle, pressure for the stream of pressurized air, distance from the orifice to the impingement point on the fuse roll.

10. The apparatus of claim 9, wherein photographic reproduction machine objective is one of body stripping, lead edge stripping, and user defined photographic reproduction machine objective;

wherein media characteristic is one of coated media, uncoated media, physical dimension of the media, and weight of the media.

11. The printing machine of claim 9, wherein determining optimization parameters is accomplished by rotating the first angle and the second angle;

wherein determining optimization values comprises adjusting the distance from the orifice to the impingement point until the response value is maximized.

12. The printing machine of claim 9, the apparatus further comprising:

sensing device to acquire a leading edge of the media passing through the nip created by the fuse roll and the pressure roll.

13. The printing machine of claim 12, wherein controlling the provided air knife is accomplished by adjusting the stream of pressurized air exiting the orifice of the air knife.

14. The printing machine of claim 13, wherein controlling the provided air knife is accomplished by adjusting the distance from the orifice to the impingement point and rotating the air knife relative to the fuse roll.

15. An electro-photographic reproduction machine comprising:

a fusing subsystem comprising a fuse roll and a pressure roll to form a nip through which media passes;

an air knife having an orifice directing a stream of pressurized air at an impingement point on the fuse roll, wherein the air knife is rotatable and displaceable relative to the fuse roll;

a processor;

a storage device coupled to the processor, the storage device further comprising executable instructions capable of directing the processor to:

determine optimization parameter values from an acquired at least one electro-photographic reproduction machine objective and media characteristic;

control the air knife based on the determined optimization parameter values; and wherein the impingement point and the orifice form a first angle about the circumference of the fuse roll;

wherein the nip and the impingement point form a second angle about the radius of the fuse roll;

wherein optimization parameter values comprise values for the first angle, the second angle, pressure for the stream of pressurized air, distance from the orifice to the impingement point on the fuse roll.

16. The electro-photographic reproduction machine of claim 15, wherein photographic reproduction machine objective is one of body stripping, lead edge stripping, and user defined photographic reproduction machine objective;

wherein media characteristic is one of coated media, uncoated media, physical dimension of the media, and weight of the media.

17. The electro-photographic reproduction machine of claim 15, wherein determining optimization parameters is accomplished by rotating the first angle and the second angle;

wherein determining optimization values comprises adjusting the distance from the orifice to the impingement point until the response value is maximized.

18. The electro-photographic reproduction machine of claim 15, the executable instructions further directing the processor to:

acquiring a leading edge of the media passing through the nip created by the fuse roll and the pressure roll;

wherein controlling the provided air knife is accomplished by adjusting the stream of pressurized air exiting the orifice of the air knife;

wherein controlling the provided air knife is adjusting the distance from the orifice to the impingement point and rotating the air knife relative to the fuse roll.

* * * * *